US005565643A

United States Patent [19]

Raines et al.

[11] Patent Number: 5,565,643

[45] Date of Patent: Oct. 15, 1996

[54] COMPOSITE DECOPPERING ADDITIVE FOR A PROPELLANT

[75] Inventors: Henry H. Raines, Tallahassee, Fla.; Steve K. Canova, Barbour, Ala.; John J. Williamson, Wakulla, Fla.; Robert T. Manning, III, Tallahassee, Fla.

[73] Assignee: Olin Corporation, St. Marks, Fla.

[21] Appl. No.: 357,906

[22] Filed: Dec. 16, 1994

[51] Int. Cl.[6] ..... C06D 5/06; F41A 21/00

[52] U.S. Cl. ..... 102/289; 102/435; 102/511; 42/76.01; 42/76.02

[58] Field of Search ..... 42/76.01, 76.02; 102/289, 511, 435

[56] References Cited

U.S. PATENT DOCUMENTS

| | | | |
|---|---|---|---|
| 1,329,610 | 2/1920 | Kessler et al. | 102/289 X |
| 2,001,070 | 5/1935 | Shankweiller et al. | 44/7 |
| 3,397,636 | 8/1968 | Jacobson et al. | 102/38 |
| 3,429,261 | 2/1969 | Goldstein | 102/38 |
| 3,672,851 | 6/1972 | Ihm | 44/7 B |
| 4,712,481 | 12/1987 | Heinrich et al. | 102/435 |
| 4,715,285 | 12/1987 | Höller | 102/435 |
| 4,858,534 | 8/1989 | Wallace | 102/511 |
| 4,949,644 | 8/1990 | Brown | 102/498 |
| 5,052,304 | 10/1991 | Rahnenführer et al. | 102/435 |
| 5,151,557 | 9/1992 | Bracuti et al. | 102/435 |
| 5,288,458 | 2/1994 | McDevitt et al. | 420/477 |
| 5,399,187 | 3/1995 | Mravic et al. | 75/228 |
| 5,463,956 | 11/1995 | Hartling | 102/282 |

OTHER PUBLICATIONS

Vezzoli et al., "Materials for De–Coppering Erosion–Resistant Gun Tubes" (publication date to be provided).

Robertson, "Decoppering of Gun Tubes by Lead" (publication date to be provided).

*Primary Examiner*—Peter A. Nelson

*Attorney, Agent, or Firm*—Gregory S. Rosenblatt

[57] ABSTRACT

There is provided a decoppering agent that is added to a propellant charge to remove copper from the rifling of the internal bore of a gun barrel. The decoppering agent consists essentially of a lead-free pulverized additive dispersed in a combustible binder. One suitable decoppering agent is pulverized bismuth metal, dispersed in a nitrocellulose binder. The bismuth metal either vaporizes or liquifies when the propellant charge is ignited and either embrittles or dissolves the copper deposits facilitating removal.

24 Claims, 1 Drawing Sheet

COMPOSITE DECOPPERING ADDITIVE FOR A PROPELLANT

GOVERNMENT LICENSE RIGHTS

The United States Government has a paid up license in this invention and the right in limited circumstances to require the patent owner to license others on reasonable terms as provided for by the terms of Contract No. DAAA21-92-C-O114 awarded by the United States Army.

FIELD OF THE INVENTION

This invention relates to an addition to a propellant charge effective for removing copper deposits from the inside surfaces of a gun barrel. More particularly, a composite addition has a pulverized decoppering agent dispersed in a combustible matrix.

BACKGROUND OF THE INVENTION

Most large caliber guns have a barrel with a rifled internal bore that imparts a stabilizing spin on an expelled projectile. The internal bore may be coated with a hard facing material, such as chromium, to minimize erosive wear increasing the number of projectiles that may be fired from the gun.

The typical large caliber projectile has a diameter slightly less than the diameter of the internal bore. One or more obturator, or rotating, bands gird the circumference of the projectile. At the bands, the diameter of the projectile is slightly larger than the internal diameter of the gun barrel. When the projectile is expelled, the rotating band is engraved by the rifling, contacting the rifling throughout the length of the tube imparting the projectile with a stabilizing spin.

The gun barrel is manufactured from a material such as steel and sometimes coated with a hard material such as a chromium facing. The gun barrel is harder than the rotating band which is typically copper or a copper alloy. As a result, a portion of the copper from the rotating band is deposited on the rifling inside the gun barrel. This copper deposition referred to as "copper fouling" can affect the ballistics of the projectile and major fouling can prevent the projectile from being inserted and seated, positioned in the barrel prior to firing, properly.

Copper fouling is currently a major problem for large artillery weapons, such as 155 millimeter howitzers, and is also noted in small and medium caliber cannons, such as 20 millimeter canons. The current solution to copper fouling is including a decoppering agent in the propellant charge. The decoppering agent removes the copper without damaging the gun barrel or the rifling.

A common decoppering agent is a sheet of lead foil deposited between the propellant and the projectile. On ignition of the propellant charge, the lead is vaporized and diffuses into the copper. The resultant alloy is brittle and easily shattered. The combination of the heat generated by the burning propellant and the mechanical movement of the propellant gases separates the brittle lead/copper alloy from the surface of the barrel. The fractured debris is swept from the muzzle of the gun with the propellant gases.

A second theory as to why lead foil is effective as a decoppering agent is that the heat generated by the burning propellant melts the lead foil. Liquid lead contacts the copper deposition and dissolves the copper, the copper bearing lead solution is expelled as a liquid from the muzzle with the propellant gases.

While metallic lead and lead compounds are effective decoppering agents, the materials are toxic to humans working around the weapons. There is a need for a lead free decoppering agent.

Among the lead free decoppering agent that have been proposed are bismuth, bismuth subcarbonate ($BiCO_3$), tin and tin alloys. Bismuth compounds are very brittle and even metallic bismuth cannot be rolled into a thin foil like lead. Alloys of bismuth metal with other metals can be rolled into a foil, but the alloys are very expensive and less effective as a decoppering agent.

There remains, therefore, a need for a method to effectively introduce a lead free decoppering agent into a propellant charge and provide this decoppering agent with a flexibility and a desired shape not achievable with the prior art lead free decoppering agents.

SUMMARY OF THE INVENTION

Accordingly, it is an object of the invention to provide an essentially lead free decoppering agent that may be formed into a desired shape. It is a feature of the invention that the decoppering agent is a composite material containing a combustible matrix and a decoppering additive dispersed throughout the matrix. It is another feature of the invention that the decoppering additive is pulverized prior to dispersion into the matrix. Yet another feature is that the composite is readily positioned at any desired location within the propellant charge.

It is an advantage of the invention that the combustible matrix is substantially consumed when the propellant is ignited. The pulverized decoppering additive is transported through the gun barrel with the propellant gases. Yet another advantage of the invention is that the composite material may be formed into a sheet and located between the propellant charge and a projectile. Still another advantage is that the composite may be formed into pellets of a desired shape and then either dispersed throughout the propellant charge or stored in small combustible containers added to the propellant charge.

In accordance with the invention, there is provided a decoppering agent for a propellant charge. The decoppering agent consists essentially of an essentially lead free pulverized additive that is effective to remove copper deposits from a gun barrel. This additive is dispersed in a combustible binder.

The above stated objects, features and advantages will become more apparent from the specification and drawings that follow.

DETAILED DESCRIPTION

Figure 1:
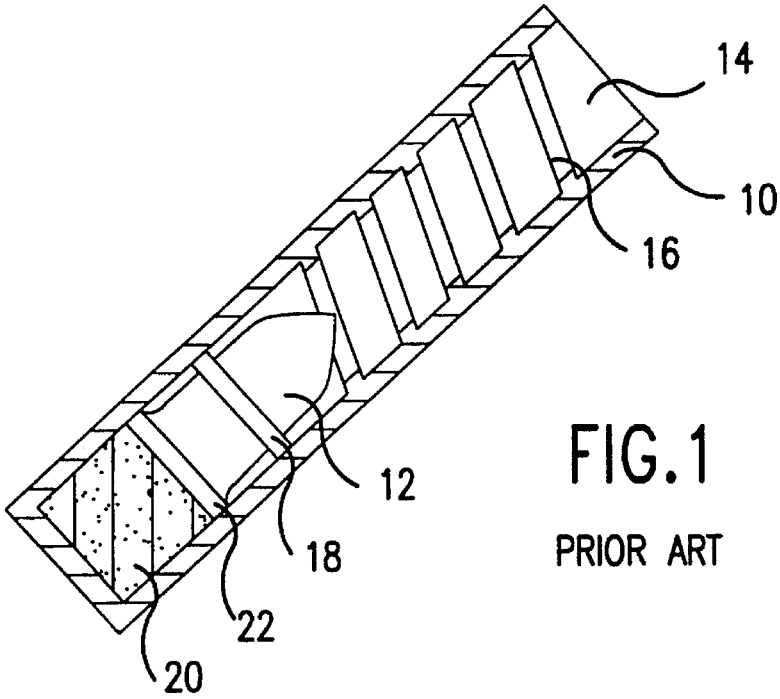
FIG.1 PRIOR ART
FIG. 1 illustrates in cross-sectional representation a gun barrel for firing a large caliber projectile as known from the prior art.

FIG. 1 shows in cross-sectional representation a gun barrel 10 for projecting a large caliber projectile 12. The gun barrel 10 has an internal bore 14 with raised rifling 16 that cooperates with a rotating band 18 to impart spin on the projectile 12. The gun barrel 10 is typically made from steel and the surfaces of the internal bore 14 may be coated with a hard facing material such as chromium. The rotating band 18 is typically formed from a relatively soft material such as copper or a copper alloy such as a copper-zinc gilding alloy.

A propellant charge 20 ignited by any conventional means (not shown) expels the projectile 12 from the gun barrel 10. As the projectile 12 travels through the internal bore 14 of the gun barrel 10, the rotating band 18 is engraved by the rifling 16, thereby imparting stabilizing spin on the projectile 12. A portion of the rotating band 18 adheres to the rifling 16. To remove this copper deposit from the rifling 16, a decoppering agent 22, typically lead, is disposed between the propellant charge 20 and the projectile 12. The heat of ignition of the propellant charge 20 either vaporizes or liquifies the low melting temperature lead decoppering agent 22 which then either dissolves or embrittles copper deposits on the rifling 16, effectively removing those deposits from the surfaces of the internal bore 14 of the gun barrel 10.

Figure 2:
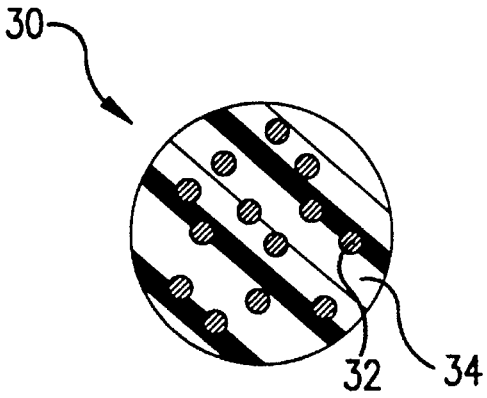
FIG. 2 illustrates in cross-sectional representation a composite decoppering agent in accordance with an embodiment of the invention.
Figure 3:
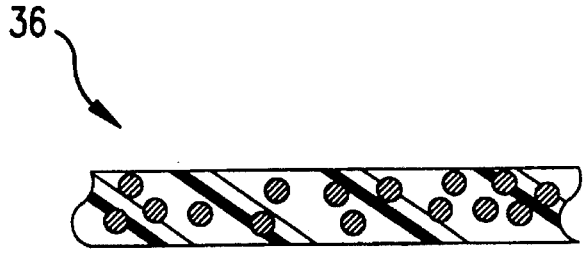
FIG. 3 illustrates in cross-sectional representation another composite decoppering agent in accordance with a different embodiment of the invention.

To replace the toxic lead decoppering agent 22, Applicants utilize the decoppering agent illustrated in cross-sectional representation in FIGS. 2 and 3. FIG. 2 illustrates a pellet 30 that may have any desired shape. The pellet 30 is an essentially lead free pulverized additive 32 dispersed in a combustible binder 34.

The pulverized additive 32 may be any material effective to remove copper deposits from the a gun barrel. By effective, it is meant that the copper deposit is substantially removed without significant corrosion, erosion or other attack of the gun barrel or the rifling.

Preferred materials for the pulverized additive 32 are bismuth metal, bismuth alloys and bismuth compounds. Preferred bismuth compounds include bismuth subcarbonate and bismuth trioxide ($BiO_3$). Other suitable materials include bismuth nitrate and bismuth antimonide, tin, tin alloys and tin compounds such as tin dioxide.

Other metals such as indium, zinc and titanium, as well as their alloys and compounds may also be useful.

While a primary objective of this invention is to provide an essentially lead free pulverized additive, it is recognized that the concept of the invention is useful for lead, lead alloy and lead compound decoppering agents. Such lead compounds include lead oxide, lead sulfate, lead carbonate hydroxide and lead carbonate.

The high solubility of copper in molten bismuth and the significant embrittling effect of bismuth on copper and copper alloys leads bismuth and bismuth compounds to be most preferred.

The pulverized additive is preferably provided as a powder, either spherical, irregular or other shape, having a maximum average cross-sectional diameter of from about 0.01 mil (0.00001 inch) to about 50 mils (0.05 inch) and more preferably, having a maximum average cross-sectional diameter of from about 1 mil to about 5 mils. The cross-sectional profile of the additive is not necessarily round. Therefore, diameter is broadly construed to mean the length of a straight line passing from one side of the additive to the other while passing through the center of the additive.

The combustible binder 34 is any material that energetically burns on ignition of the propellant. The combustible binder 34 should burn with a minimum generation of ash and other residues. The combustible binder is preferably a polymeric material that holds the pulverized additive 32 together as a pellet or other desired shape. The binder preferably also provides both fuel and oxygen to the propellant charge during combustion. One preferred binder is nitrocellulose having either a low degree of nitration (approximately 12.6% by weight nitrated) or a high degree of nitration (around 13.5% by weight nitrated). Nitrocellulose with an intermediate degree nitration, typically 13.15% nitration, is commonly used in gun propellants and is readily available. Preferred is a nitrocellulose having from about 12.6% to about 14% nitration and, most preferably, with from about 13.1% to about 13.5% nitration. The degree of nitration is selected to provide a desired ignitability and burn rate.

Other energetic binders can also be used, as can nonenergetic binders. Suitable nonenergetic binders, such as cellulose acetate butyrate, are less preferred because they do not contribute to the combustion reaction to the same degree as nitrocellulose.

The pellet 30 can have from about 5% to about 95% by weight of the pulverized additive 32. If the pellet 30 has a low percentage of pulverized additive 32, then achieving an effective amount of decoppering material may require a large number of decoppering pellets 30. This may result in a significant amount of actual propellant being displaced and overall interior ballistics may be detrimentally impacted. If the decoppering pellets are made with a high percentage of pulverized additive, they may not burn properly and leave unwanted residue in the gun chamber. The pellet 30 contains from about 5% to about 95% by weight of the pulverized additive. Preferably, the pellet 30 contains from about 25% to about 75% by weight of the pulverized additive and more preferably, the pulverized additive is present in an amount of from about 30% to about 45%.

The specific gravity (density) of the pellets 30 is controlled by the manufacturing process. The ignitability and burn rate of the pellets is directly proportional to the initial surface area and the amount of surface area during the propellant burn. A porous pellet (lower specific gravity) has more initial surface area and will ignite faster. A more dense pellet (higher specific gravity) has less initial surface area and will ignite and burn slower.

Preferably, when the pellets comprise bismuth in a nitrocellulose matrix, the specific gravity is from about 1.0 to about 4.0 grams per cubic centimeter, and most preferably from about 1.5 to about 2.5 g/cm$^3$. When the specific gravity is greater than about 4.0 g/cm$^3$ the burn rate is generally too slow for use in propellant charges. The pellet leaves unburnt residue in the gun chamber or the barrel. A specific gravity of less than 1 g/cm$^3$ lacks the necessary mechanical strength to survive incorporation into a charge and handling the charge may undergo before firing. If the grains break apart during loading or handling, they will not burn properly during combustion.

In addition to the pulverized additive 32, other materials may also be dispersed in the combustible binder 34. These other materials are for such desirable purposes as suppressing muzzle flash and inhibiting barrel wear. For example, 1% to 95% by weight potassium sulfate ($K_2SO_4$) may be added as a muzzle flash suppressor. A preferred amount of $K_2SO_4$ is from about 20% to about 75% by weight, with a most preferred amount being from about 20% to about 40% by weight.

Titanium dioxide ($TIC_2$) in an amount of from about 1% to about 95% by weight, and preferably from about 25% to about 75% by weight, may be added to inhibit barrel wear. A most preferred amount of $TiO_2$ is from about 20% to about 40% by weight.

An energetic plasticizer may be added to increase the burn rate of the pellets 30 thereby minimizing or eliminating residue after firing. The energetic plasticizer is also useful to modify the mechanical properties of the pellets 30, to increase the energy rate of the pellets and to increase the flame temperature of the pellets. Suitable energetic plasticizers include nitrate esters such as nitroglycerine and diethylene glycol dinitrate present in an amount, by weight, of from about 1% to about 40%. Preferably, the amount of the energetic plasticizer is from about 1% to about 20% by weight.

The additional additives may be added singly or in multiple combinations.

The pellet 30 as illustrated in FIG. 2 has a substantially round cross-sectional profile, as for example a flat disk. However, any suitable shape may be used, recognizing that the ignitability and burning velocity (burn rate) of the pellet is dependent on the overall surface area as the grain burns. The geometric shape can be adjusted and changed to improve both the ignitability and burn rate. Grains with more surface area, such as cruciform, multiply perforated and lobed pellets will burn faster. Other shapes, such as flat disks, right circular disks (both solid and single perforated) and spheres have less surface area and will ignite slower. This property of controlling the shape of the pellet 30 gives propellant charge designers the additional benefit of flexibility in tailoring the ignitability and burn rate of the additive grain to a specific propellant charge.

The pellets 30 are introduced to the propellant charge according to the needs of the propellant charge designer. The pellets may be sewed into a fiber bag or other special container, attached to the wall of the propellant charge or to the propellant base with an adhesive or other means of attachment, added directly to the propellant bed, added to other materials such as an igniter or primer material or attached to or contained within the primer.

The decoppering agent can be in the form of a sheet 36 as illustrated in cross-sectional representation in FIG. 3 to line the propellant charge or be disposed between the propellant charge and the projectile.

While the decoppering agent of the invention has been described most particularly in relation to large caliber guns, it is equally suitable to both medium caliber and low caliber gun barrels. It is equally usable for high zone artillery charges, those operating at higher pressures and temperatures, as well as low zone artillery charges, those operating at lower pressures and temperatures. Of course, the specific gravity and shape of the pellets will be tailored for an ignitability and burn rate suitable for each type of artillery charge.

A preferred method of manufacturing either the pellet 30 of FIG. 2 or the sheet 36 of FIG. 3, is to provide the essentially lead free additive pulverized by any suitable means. For example, bismuth metal may be pulverized by mechanical grinding or any other suitable means. The pulverized additive is then dispersed in a viscous liquid solution containing nitrocellulose dissolved in a mixture of water and an organic ester. Prior to dissolution, cellulose was nitrated to the desired degree according to conventional nitrating practice.

The viscous liquid solution containing the dissolved nitrocellulose and suspended pulverized additive is then extruded through a die having orifices of a desired cross sectional profile. The extruded strands are cut at a desired thickness and the liquid component then removed by evaporation, preferably assisted by the addition of heat.

It is apparent that there has been provided in accordance with this invention, a decoppering agent for a propellant charge that fully satisfies the objects, means and advantages set forth hereinbefore. While the invention has been described in combination with specific embodiments thereof, it is evident that many alternatives, modifications and variations will be apparent to those skilled in the art in light of the foregoing description. Accordingly, it is intended to embrace all such alternatives, modification and variations as feel with the spirit and broad scope of the appended claims.

We claim:

1. A decoppering agent for a propellant charge consisting essentially of an essentially lead free pulverized additive effective to remove copper deposits from a gun barrel dispersed in a combustible binder matrix, said combustible binder matrix generating a minimal amount of residue when burned.

2. The decoppering agent of claim 1 wherein said combustible binder is nitrocellulose.

3. The decoppering agent of claim 2 wherein said nitrocellulose has a degree of nitration of from about 12.6% to about 14% by weight.

4. The decoppering agent of claim 3 wherein said degree of nitration is from about 13.1% to about 13.5% by weight.

5. The decoppering agent of claim 3 wherein said pulverized additive is selected from the group consisting of metallic bismuth, bismuth alloys and bismuth compounds.

6. The decoppering agent of claim 5 wherein said pulverized additive is metallic bismuth.

7. The decoppering agent of claim 6 wherein said pulverized additive has an average maximum diameter of from about 0.01 mil to about 50 mils.

8. The decoppering agent of claim 7 wherein said pulverized additive has an average maximum diameter of from about 1 mil to about 5 mils.

9. The decoppering agent of claim 7 further containing from about 1% to about 95% by weight of potassium sulfate.

10. The decoppering agent of claim 7 further containing from about 1% to about 95% by weight of titanium dioxide.

11. The decoppering agent of claim 7 further containing from about 1% to about 40% by weight of a nitrate ester energetic plasticizer.

12. A decoppering agent for a propellant charge consisting essentially of a lead containing pulverized additive effective to remove copper deposits from a gun barrel dispersed in a combustible binder matrix, said combustible binder matrix generating a minimal amount of residue on burning.

13. The decoppering agent of claim 12 wherein said combustible binder is nitrocellulose having a degree of nitration of from about 12.6% to about 14% by weight.

14. The decoppering agent of claim 13 wherein said lead containing pulverized additive is selected from the group consisting of metallic lead, lead alloys and lead compounds.

15. The decoppering agent of claim 14 wherein said lead containing pulverized additive has an average maximum diameter of from about 0.01 mil to about 50 mils.

16. A decoppering agent for a propellant charge, consisting essentially of:

from about 1% to about 95% by weight of potassium sulfate; and an essentially lead free pulverized additive effective to remove copper deposits from a gun barrel having an average maximum diameter of from about 0.01 mil to about 50 mils, both said potassium sulfate and said essentially lead free pulverized additive being dispersed in a combustible binder that burns with a minimal generation of residue.

17. A decoppering agent for a propellant charge, consisting essentially of:

from about 1% to about 95% by weight of titanium dioxide; and an essentially lead free pulverized additive effective to remove copper deposits from a gun barrel having an average maximum diameter of from about 0.01 mil to about 50 mils, both said potassium sulfate and said essentially lead free pulverized additive being dispersed in a combustible binder matrix that burns with a minimal generation of residue.

18. The decoppering agent of claim 17 wherein said pulverized additive is selected from group consisting of metallic bismuth, bismuth alloys and bismuth compounds.

19. A decoppering agent for a propellant charge consisting essentially of an essentially lead free pulverized additive effective to remove copper deposits from a gun barrel dispersed in a cellulose acetate butyrate binder matrix.

20. A decoppering agent for a propellant charge, consisting essentially of:

from about 1% to about 95% by weight of potassium sulfate; and a pulverized additive selected from the group consisting of metallic lead, lead alloys and lead compounds having an average maximum diameter of from about 0.01 mil to about 50 mils with said potassium sulfate and pulverized additive both dispersed in a nitrocellulose binder matrix having a degree of nitration of from about 12.6% to about 14%, by weight.

21. The decoppering agent of claim 15 further containing from about 1% to about 95% by weight of titanium dioxide.

22. The decoppering agent of claim 15 further containing from about 1% to about 40% by weight of a nitrate ester energetic plasticizer.

23. The decoppering agent of claim 16 wherein said pulverized additive is selected from the group consisting of metallic bismuth, bismuth alloys and bismuth compounds.

24. The decoppering agent of claim 19 wherein said pulverized additive is selected from the group consisting of metallic bismuth, bismuth alloys and bismuth compounds.

* * * * *